US005218812A

United States Patent [19]

Ventura et al.

[11] Patent Number: 5,218,812

[45] Date of Patent: Jun. 15, 1993

[54] PACKING STATION FOR LETTUCE RECEIVING TRAYS

[75] Inventors: Leon P. Ventura, Watsonville; Javier Diaz-Infante, Salinas; Edward Wynn, Monterey; Peter deGroot, Marina; Anna M. Boeh, San Jose, all of Calif.

[73] Assignee: Bud of California, Salinas, Calif.

[21] Appl. No.: 754,985

[22] Filed: Sep. 5, 1991

[51] Int. Cl.[5] ..... B65B 67/00

[52] U.S. Cl. ..... 53/391; 53/390; 53/448; 53/537; 53/543; 198/314; 414/743

[58] Field of Search ..... 414/742, 743; 198/314, 198/465.1; 53/247, 390, 391, 448, 475, 537, 539, 543

[56] References Cited

U.S. PATENT DOCUMENTS

| | | | |
|---|---|---|---|
| 1,246,334 | 11/1917 | Sears | 53/390 |
| 1,894,851 | 1/1933 | Cockrill et al. | 53/390 |
| 2,057,284 | 10/1936 | Walker | 53/390 |
| 2,699,277 | 1/1955 | Martin | 53/391 |
| 3,167,197 | 1/1965 | Lee | 414/743 X |
| 4,522,016 | 6/1985 | DiRico | 53/390 X |
| 4,616,468 | 10/1986 | Munoz | 53/391 |
| 4,876,844 | 10/1989 | Grey | 53/391 X |
| 4,884,388 | 12/1989 | Ventura et al. | 53/390 X |
| 4,909,697 | 3/1990 | Bernard et al. | 53/391 X |
| 5,121,589 | 6/1992 | Ventura et al. | 53/391 X |

*Primary Examiner*—John Sipos
*Assistant Examiner*—Daniel Moon
*Attorney, Agent, or Firm*—Townsend and Townsend

[57] ABSTRACT

An arm and cradle apparatus is disclosed for receiving empty trays from an upper conveyor having empty lettuce holding and transporting trays, lowering the received empty tray to an angular disposition in which it can most conveniently be packed, and finally off loading the packed full tray to a lower conveyor having full lettuce holding trays thereon for plunging to cartons. The arm and cradle apparatus is mechanically passive in that all movements of the trays to and from the arm and cradle apparatus are either worker assisted or occur under the natural gravity biased movement of the arm and cradle apparatus.

20 Claims, 11 Drawing Sheets

PACKING STATION FOR LETTUCE RECEIVING TRAYS

This invention relates to the automated packaging of lettuce and other produce similar to lettuce. Specifically, improvements are set forth to that automated packaging apparatus set forth in Ventura et al. U.S. Pat. No. 4,884,388 entitled LETTUCE PACKER issued Dec. 5, 1989. The improvements set forth herein relate to an improved packing station which enables empty lettuce holding trays to be moved from an upper conveyor having empty trays disposed thereon to a packing disposition where attending workers can most conveniently pack the tray, and finally removal of the packed tray to a lower conveyor for packing to cartons.

BACKGROUND OF THE INVENTION

In the Ventura et al. U.S. Pat. No. 4,884,388 for LETTUCE PACKER, an apparatus was set forth for producing by automated lettuce packing, a carton of packed lettuce that was superior to a similar carton packed by hand. This apparatus, so far as is relevant herein, can be summarized by first describing the lettuce holding trays, secondly setting forth the configuration of the packing station (hereinafter referred to as the "plunging station"), and thereafter describing briefly the superiority of the resulting packed carton over the hand packed carton of the prior art.

The Ventura et al. Patent disclosed a lettuce holding tray. The purpose of the tray was to hold packed lettuce, transport the packed lettuce, and allow the lettuce to be moved as packed from the tray to an awaiting carton for shipment in the carton to market.

The type of packing here utilized is the so-called "naked pack" of lettuce within a carton. In the naked pack technique, lettuce heads are placed side-by-side within a carton without the lettuce being either wrapped or held by separating material.

The trays are fabricated to hold a single layer of lettuce being placed within a box. Lettuce is typically packed two layers high within a receiving box. Each of these layers includes the placement of four rows of lettuce in packed side-by-side relation with each row being three heads wide.

The tray includes longitudinal and transverse upper members defining a matrix of interstitial lettuce receiving cells therebetween. The defined matrix circumscribes individual cells surrounding each head of lettuce in a layer of a box. Thus the matrix of the tray defines a series of lettuce receiving cells having four rows, each row with three side-by-side positions for receiving a total of twelve heads of lettuce.

Cell sides are provided for allowing the lettuce placed in each cell to be held in each cell and further for permitting lettuce to be packed from each cell by being plunged out of the cell through the bottom of the tray. Specifically, the cell sides comprise sheets of flexible material fastened at the top to the matrix. The sheets of flexible material depended from the matrix inwardly of each cell. These flexible tray sides are preferably fabricated from stainless steel sheet metal.

The function of the flexible sides of the cells of the tray is easily understood. Lettuce placed within the cell is oriented to the desired packed disposition in the carton and thereafter held to the cell by the flexible sides in its desired orientation. A fully packed tray having the lettuce held in each cell therein can be transported from a station where it is packed to another station where it is plunged to a carton.

The removal of the lettuce from the tray is likewise easy to understand. Specifically, an array of plungers is utilized. Similar to the rows of cells in the lettuce receiving tray, the plunger array includes four rows of three side-by-side plungers. These plungers are oriented to and toward a tray positioned between the overlying plungers and the underlying carton.

The plungers simultaneously move through a tray packed with heads of lettuce oriented to their desired packed orientation. The lettuce moves out of the tray and into the carton without changing the original orientation that the lettuce had in the holding and transporting tray. Packing of a single layer of the carton occurs with a single simultaneous stroke of the twelve plungers of the plunger array.

In the Ventura et al. Patent, a single array of twelve plungers was utilized. Consequently, packing of the lower layer of a lettuce carton first occurs. Thereafter—and utilizing the same plunging mechanism—packing of the upper layer occurs. There results a packed carton of lettuce having demonstrably improved characteristics.

The superiority of the machine packed lettuce can be summarized. The heads of lettuce as packed by the plungers move without relative rotation one to another as they pass from the tray to the carton. An entire layer of the lettuce carton is packed by the plunger array at a single stroke; this is an operation that is not possible to duplicate by hand. There results a regularity in the packing of each of the two layers of the carton that is readily discernable upon the opening of the carton. The outer lettuce leaves of the carton form an almost square perimeter. These leaves of lettuce, while having this square perimeter, have minimal spoilage. This regularity of lettuce head packing enables the product to be shipped with greatly reduced damage. As a consequence, cartons of lettuce packed in accordance with this "naked" pack technique ship with less deterioration to the conventional hand packed "naked" lettuce and command a premium price over conventional hand packed lettuce equivalents.

The Ventura et al. Patent was primarily directed to the packing process described. Although it was suggested that the trays be disposed to the workers at elevations and angles where the lettuce holding trays could most conveniently be packed, a commercially practical packing station was not disclosed. Moreover, provision for the smooth flow of lettuce through the packing station including loading from a conveyor having empty trays, packing at the station, and conveyance to d conveyor having full trays was set forth in a prototype configuration only.

SUMMARY OF THE INVENTION

An arm and cradle apparatus is disclosed for receiving empty trays from an upper conveyor having empty lettuce holding and transporting trays, lowering the received empty tray to an angular disposition in which it can most conveniently be packed, and finally off-loading the packed full tray to a lower conveyor having full lettuce holding trays thereon for plunging to cartons. The arm and cradle apparatus is mechanically passive in that all movements of the trays to and from the arm and cradle apparatus are either worker assisted or occur under the natural gravity biased movement of the arm and cradle apparatus.

The tray holding apparatus at each packing station includes paired counterbalanced arms for lowering of the received empty tray from the upper conveyor to the elevation of the lower conveyor where the tray is packed and ultimately discharged full to the lower conveyor. These arms are pivoted at an inward end at the machine so that the arms can move under counter weighted movement between an upper tray receiving position to a lowered tray discharging position.

The ends of the arm remote from the machine are also provided with pivots. At these pivots there is provided a tray receiving cradle. This tray receiving cradle pendulously pivots with respect to the arms as the arms in turn pivot with respect to the main frame of the harvesting machine.

The cycle of the pivoting counter weighted arms and pivoting tray receiving cradle can be easily understood. In the following description, it will be presumed that the tray receiving cradle has just been emptied of a fully packed lettuce tray to the lower tray receiving conveyor and that it is desired to supply the packing station with a new, empty tray from the upper empty tray conveyor for furthering the harvest.

When the counter weighted arms are pivoted to the upper position, the tray receiving cradle pivots pendulously with respect to the arms to a horizontal tray receiving disposition against confronting stops acting on the arm and cradle. It is locked to this pivoted position against confronting stops on the cradle and the arms by an over center gas or mechanical spring; movement of the tray receiving cradle from its pivoted angularity with respect to the arms cannot occur until the force of the over center pneumatic spring is overcome.

When the elevation and pivot of the tray receiving cradle is complete to the elevation of the upper conveyor having the empty lettuce receiving trays thereon, conventional conveyor bridge lifts elevate an empty lettuce receiving tray. These conventional bridge lifts served to elevate the tray from the chain conveyor where the tray is conventionally transported longitudinally of the machine, to an elevated disposition where the tray may roll on tray mounted wheels. This rolling transport of the tray is transverse of the frame of the machine.

The tray receiving cradle is give a U-shaped configuration that disposes the open portion of the "U" to and towards the workers manning the packing station. Consequently, the worker(s) can reach the empty lettuce receiving tray elevated on the bridge lifts and pull that empty tray onto the cradle. The cradle is thus loaded—in the upper elevated position—with an empty tray ready to be packed.

The weight of the empty lettuce receiving tray—on the order of one hundred fifty pounds—overcomes the counter weighted movement of the counter balanced pivoting arms in their upper position. These arms—damped in their movement by a damper or shock absorber—gradually pivot downward under the weight of the received, empty lettuce holding tray. This counter balanced movement continues until the empty tray is disposed at an elevation wherein the empty tray can easily be loaded.

During this downward pivotal movement, the tray receiving cradle is prohibited by the over center pneumatic spring acting between the cradle and the arms from undergoing pivotal movement with respect to the arms. This restraint of pivotal movement causes the tray to be angularly disposed at the ends of the arms at an angularity of 15° from the vertical where packing of the tray with harvested heads of lettuce can easily occur. Thus in a single downward pivotal movement, the loaded by empty tray is disposed at a convenient angularity where it can receive and be packed with recently harvested heads of lettuce. Packing of the tray to a loaded disposition easily occurs.

It should be noted that the loading motion of the empty tray onto the tray receiving cradle is adjustable as to the position of penetration of the tray to the cradle. This adjustability of penetration to the cradle has a benefit not immediately apparent. Specifically, and when the cradle and counter balanced arms move to the lower disposition, the elevation of the angularly disposed tray with respect to the crop being harvested is variable. Thus, the lettuce receiving trays disposed at the lowered cradle and arms are individually adjustable in elevation. The harvesting heights required for the maximum convenience of the attending picking and packing workers can be individually accommodated.

When the tray is completely packed, the worker(s) pivot the tray from its angular 15° disposition from the vertical wherein lettuce heads are easily packed to a horizontal position. This manual pivot supplied by the workers overcomes the bias provided by the over center pneumatic spring acting between the cradle and the arms. When this bias is overcome, the tray and cradle pendulously move on the pivots at the ends of the arms to a horizontal position with respect to the arms. The cradle stops this pendulous movement when second confronting stops on the arm and cradle come into contact one with another.

In this horizontal position the tray is disposed at the same plane with conventional bridge lifts for the rolling transport of the tray to a position overlying an empty position on the lower full tray receiving conveyor. Again such movement is caused by the workers pushing the tray, and having the tray move on bottom mounted wheels from the cradle to the elevated bridge lifts for subsequently lowering to and transport on the lower conveyor having the full trays for plunging to cartons.

The simultaneously moving arms are in turn provided with their own over center gas or mechanical springs acting between the arms, main machine body and stops. These arm over center pneumatic springs tend to confine the arms against stops in their lowered and cradle empty position. At the same time, the upper ends of the arms on the opposite side of the machine pivot dispose guides for confining trays on the upper conveyor to the upper conveyor.

Presuming that the cradle is to be reloaded with an empty lettuce receiving tray, the worker(s) at the packing station bias the arms against the over center pneumatic spring and overcome the arm over center pneumatic spring. When this bias is overcome, the counter balanced arms pivot upwardly raising the now empty cradle to the upper pivoted position. At the same time, the cradle pendulously pivots with respect to the arms maintaining a horizontal position. When the tray is fully moved to the upper position, loading of the tray continues and the cycle repeats.

The disclosed counter balance arms and cradles are disposed on both sides of an elongate machine frame that spans the crop being harvested. The machine is powered by four phase linked but separately powered hydraulic wheels. For minimizing end of the row maneuvering, it is required that this machine frame be reversible.

When the machine frame is reversible, it is convenient to dispose counter balanced arms and cradles on both sides of the machine. While the machine travels in one direction, one set of arms on one side of the machine is used for the conveyance of the lettuce receiving trays. When the machine travels in the opposite direction, the other set of arms on the other side of the machine are used for the conveyance of the lettuce receiving tray. Thus the disclosed packing station apparatus is reversible in that the same harvester can travel in opposite directions and still dispose packing stations conveniently and preferably to the trailing edge of the machine frame.

Provision is made to provide the conveyors and bridge lifts with automated operation. All signals required for the automated operation either come from the movements of the lettuce loading trays or the positions of the arms and tray receiving cradles.

DESCRIPTION OF THE PREFERRED EMBODIMENT

Figure 1A:
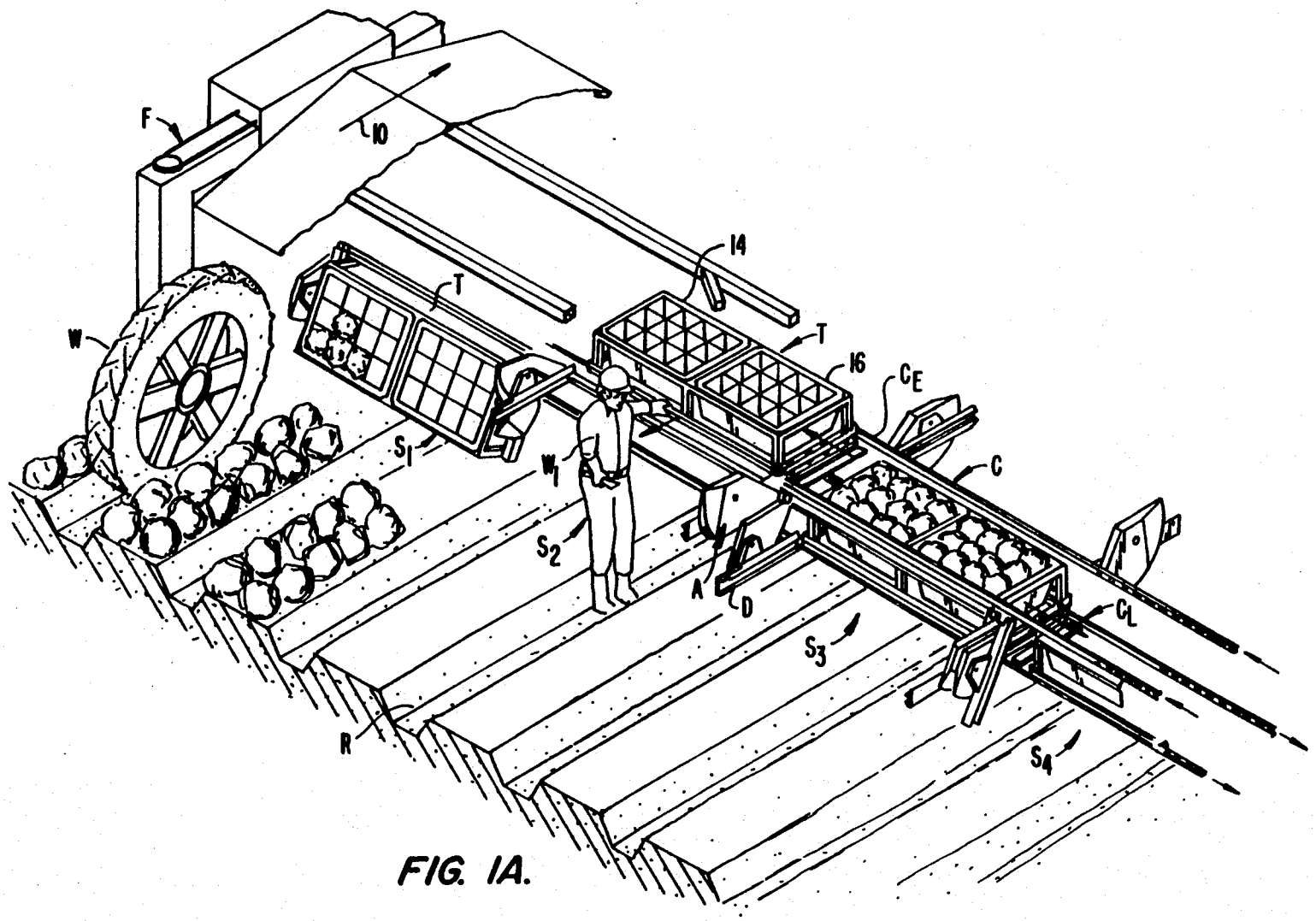
FIGS. 1A and 1B are a perspective view of a lettuce packing and carton plunging machine according to this invention with FIG. 1A illustrating the left portion of such a machine including packing stations and conveyors and FIG. 1B illustrating the right portion of such a machine including the ends of the respective conveyors, the carton plunging station, and the elevator therebetween.
Figure 1B:
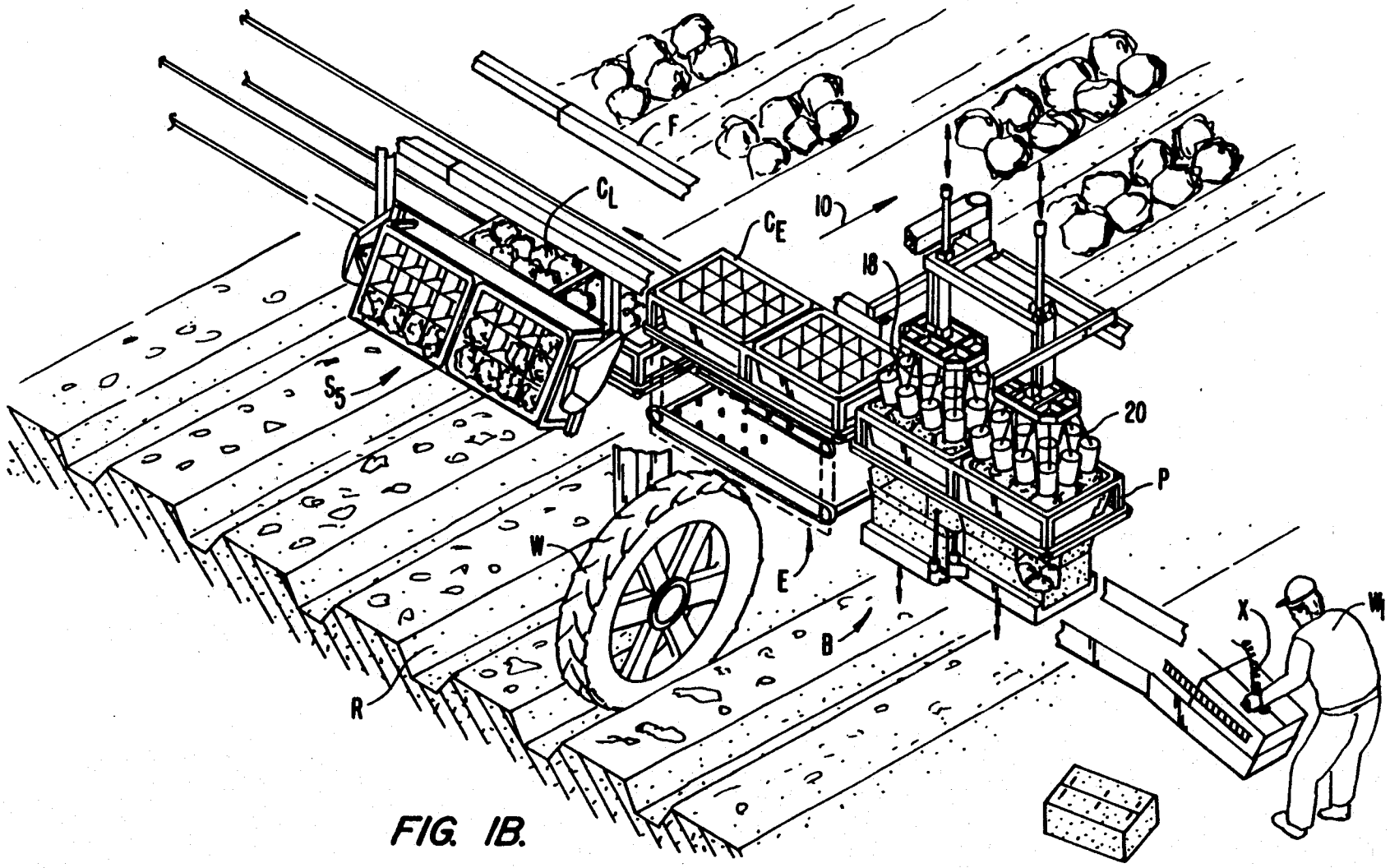

Referring to FIGS. 1A and 1B, the overall configuration of this invention may be understood. The harvester of this invention includes an elongate frame F mounted on wheels W. When transport of the frame F occurs over rows R containing a crop such as lettuce, the longitudinal axis of frame F is normal to the row R.

Wheels W are typically each driven by individually powered hydraulic motors. The wheels are phase locked in their rotation to assure uniform transport of frame F transversely of a field having a crop of lettuce planted in rows R.

Frame F supports five packing stations S1–S5. These respective packing stations are typically on the trailing side of the machine which preferably traverses the field in the direction of arrows 10. As will hereafter fully be made clear, the transport of frame F is reversible. Consequently, packing stations S1–S5 can be disposed from both sides of frame F. Normally, the machine is attended by approximately eleven picking workers, and two workers attending the lettuce plunging apparatus P which effects the automated packing of the lettuce in cartons for shipment to market.

The trays T each contain twenty-four heads of lettuce. As will hereinafter be more fully explained, a first half of the tray of each tray 14 contains the bottom packed layer of a box of lettuce; the second half of the tray 16 contains a top half of a carton of packed lettuce.

Figure 3A:
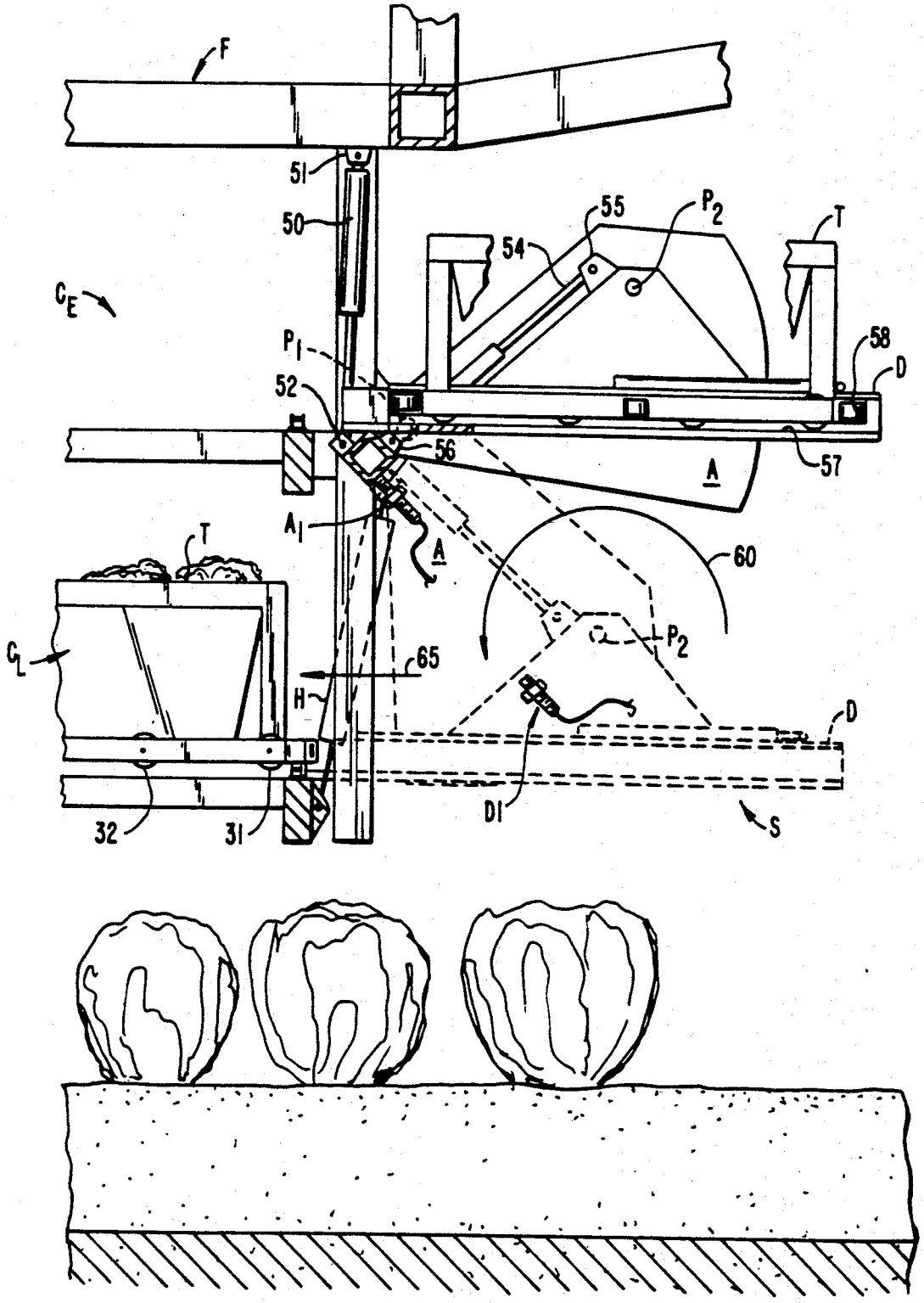
FIGS. 3A and 3B are respective elevations of the machine with FIG. 3A illustrating movement of the counter balanced arms and cradle from a lower disposition where a loaded tray of lettuce has been discharged to an upper disposition where an empty tray from the upper conveyor can be received to the cradle and FIG. 3B illustrating movement of the counter balanced arms and cradle from an upper disposition where a tray is loaded to the tray receiving cradle to a lowered disposition where the tray is held by the over center pneumatic spring at an angularity where it can be most conveniently packed with lettuce pick from the field.
Figure 3B:
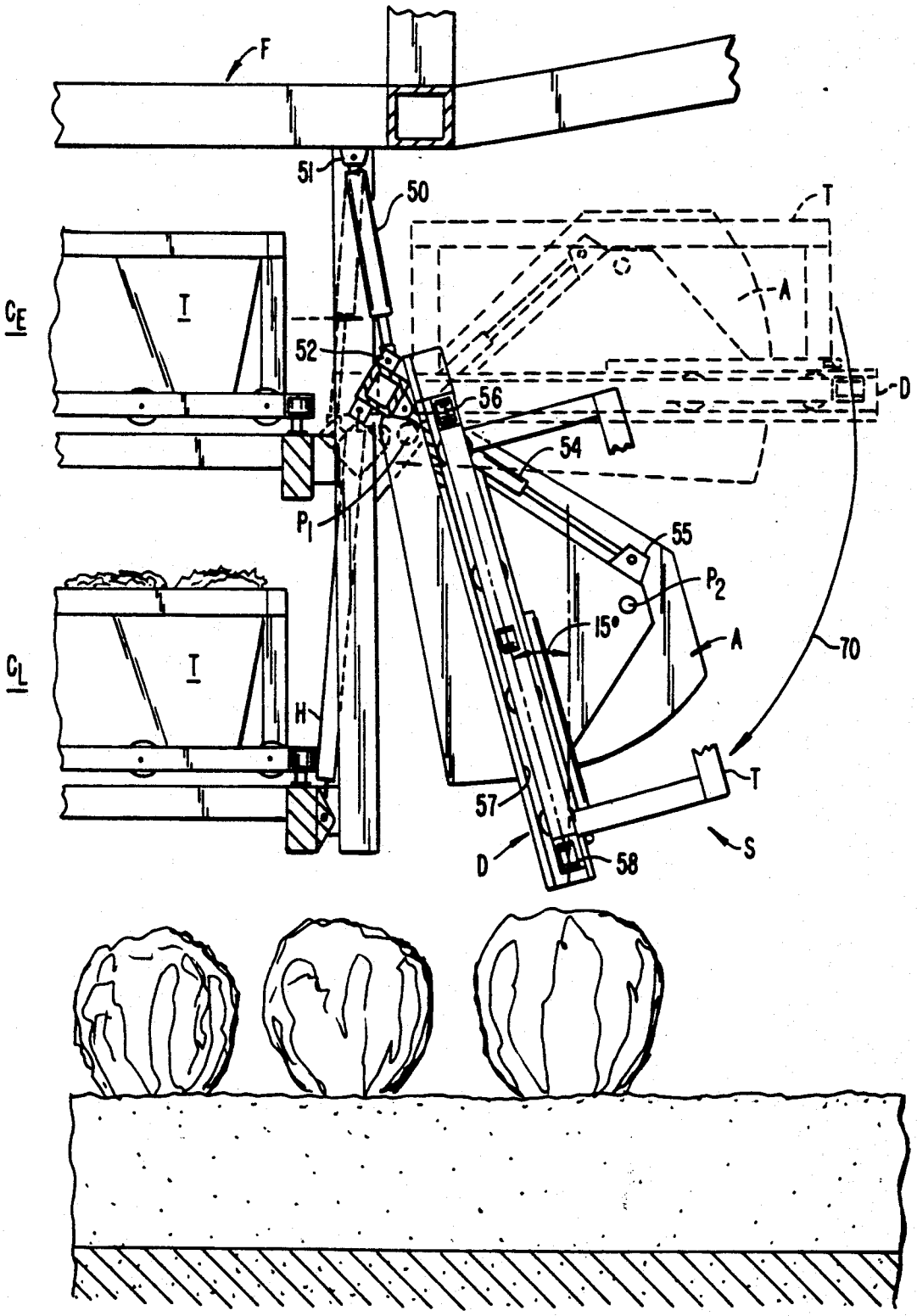

During picking, the tray T occupies an angular position inclined on the order of 15° from the vertical (see FIG. 3B). The individual lettuce receiving cells of the tray are addressed to the trailing side of the machine as shown in FIG. 1A at station S1. In this position the lettuce can most conveniently be placed into the individual cells of the tray T to fill the tray with 24 heads of freshly picked lettuce.

When the tray is full, it is pivoted on a cradle D attached to arms A. Such pivot enables rolling transport of the full tray of lettuce occurs to a lower conveyor $C_L$ of a conveyor pair C. Thereafter, cradle D is pivoted on arms A and elevated to an upward position as shown at station S2 and an empty tray pulled onto the cradle. The cradle thereafter falls under the weight of gravity to the position illustrated in FIG. S1.

Thus, it will be seen that the packing station of this invention accomplishes two purposes. First, it affects a conveyance of the trays T from the empty conveyor $C_E$ to the lower loaded conveyor $C_L$. Secondly, and during this transport between the two conveyors, it disposes the tray T in a position where it may be most conveniently packed with lettuce as at station S1.

Conveyors $C_L$ and $C_E$ serve to convey the trays between the stations S1–S5 where picking occurs and an elevator E. Elevator E serves to elevate the loaded trays T from conveyor $C_L$ to a plunger mechanism P. Plunger mechanism P has the function of packing lettuce cartons transported on a box conveyor B. Twelve plungers 18 pack the portion 14 of tray T to a bottom layer of a first carton. Likewise, twelve plungers 20 pack the top layer of a tray T at portion 16 to a carton. Thus, it can be seen that each lettuce tray is simultaneously packed into the bottom portion of a carton at portion 14 and the top portion of a carton at adjoining portion 16. The carton, when fully packed, is thereafter transported to a stapling station X for closure and discharge to transport apparatus where transport to a cooler followed by refrigerated shipment to market occurs.

Having summarized the overall operation of this invention, attention will now be directed in detail to the discrete portions of this invention.

Lettuce Receiving Tray

Figure 2:
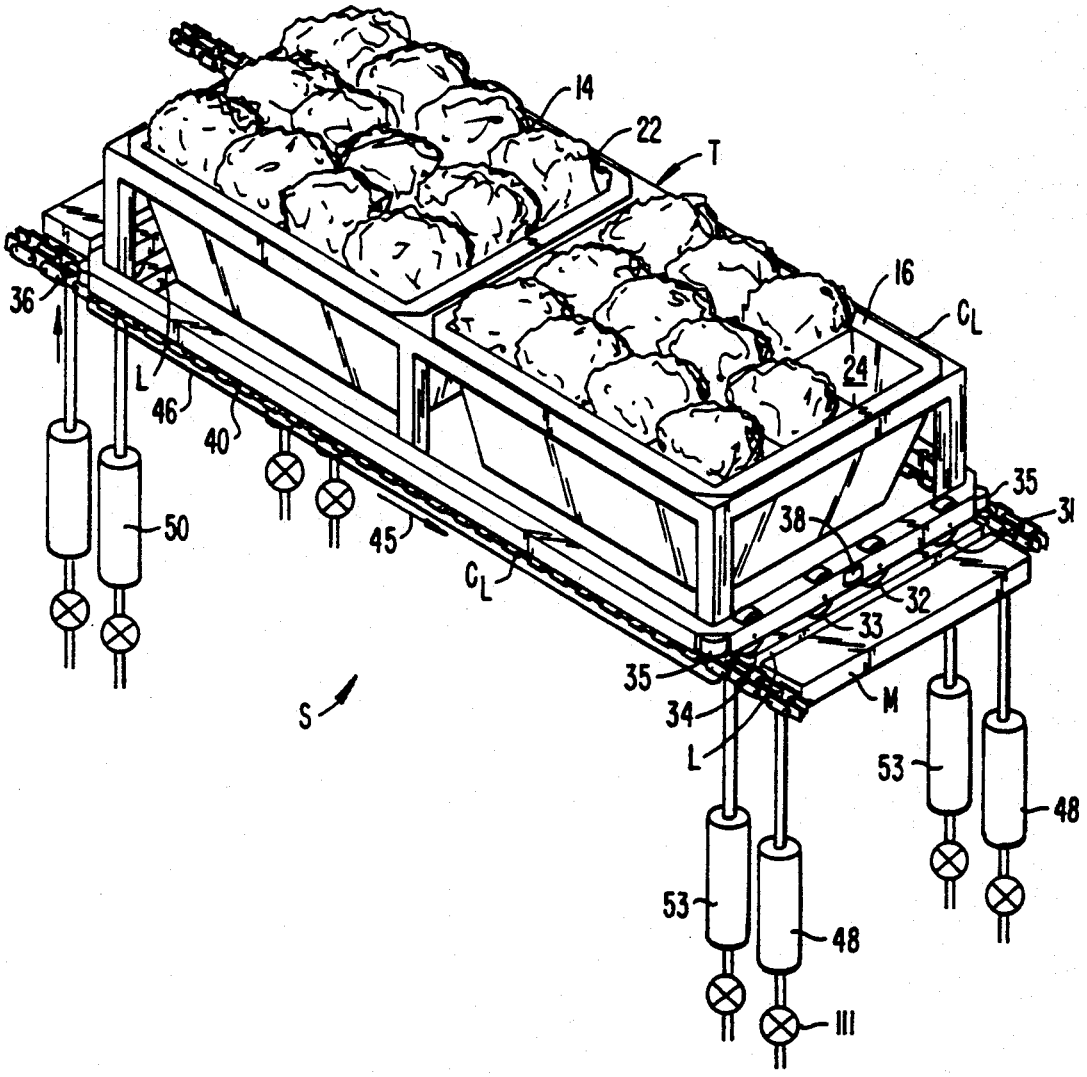
FIG. 2 is a perspective schematic of a typical conveyor illustrating the conveyed tray, a dam for stopping the tray in the vicinity of one of the packing stations, and the cooperating bridge lifts for enabling transport of the tray to and from the conveyor.

Referring to FIG. 2, tray T is illustrated. As can be seen, it includes in section 14, twelve discrete cells 22. These discrete cells are for holding the bottom layer of lettuce packed within the box. Heads of lettuce packed to this section of the tray are disposed with their respective butts downward; in this disposition these lettuce head butts confront the bottom of the cartons into which they are placed.

Additionally, and at section 16 of tray T, twelve discrete cells 24 are utilized. These discrete cells are for holding the top layer of lettuce packed within the box. Heads of lettuce packed to this section of the tray are disposed with their respective butts to the side; in this disposition these lettuce head butts are disposed to the sides of the cartons into which they are placed. When disposed to the sides, these lettuce head butts are disposed interstitially of the otherwise tightly packed lettuce where they may not damage the lettuce leaf of adjacent tightly packed lettuce heads.

The tray construction of each half 14, 16 of the tray is more fully described in Ventura, et al., U.S. Pat. No. 4,884,388, entitled "Lettuce Packer", issued Dec. 5, 1989, which application is incorporated by reference herein. It is to be noted that this patent only describes one tray half 14 or 16; it does not disclose or suggest the double tray herein utilized.

The tray T has two modes of transport. One mode of transport is conventional transport parallel to the longitudinal axis of the tray on conveyors C. In this transport mode, the tray T is supported on two endless chains 40 and conventionally carried by the chain parallel to its major longitudinal axis.

In the second mode of transport, the tray T undergoes rolling transport. In this transport mode, the tray T is supported on wheels, pulled or pushed by workers parallel to its minor axis (and normal to the longitudinal axis) for movement off of and onto conveyors C.

Referring to FIG. 2, it will be seen that two discrete sets of rollers are included with each tray. There are bottom exposed rollers 31–34, which rollers enable the tray to be rolled to and from a chain conveyors C.

Rollers 35, 36 are placed at the corners of the tray. These rollers aid the tray to pass on guides longitudinally of the conveyors $C_L$, $C_E$.

Finally, side rollers 38 are exposed on each end of tray T. These respective side rollers 38, along with rollers 35, 36 enable the tray to pass in and out of the cradle D as tray T move to and from the respective conveyor C.

As is conventional, the bottom of the tray has an anti-friction, anti-wear material, preferably ultra-high molecular weight polyethylene (not shown). The tray is conveyed on a endless chain 40, which endless chain continually moves. This endless chain bears directly against the ultra-high molecular weight polyethylene and enables the tray either to be transported with chain 40 or to remain stationary while chain 40 passes underneath the tray T.

Chains 40 have constant motion; the trays T do not have constant motion. Specifically, the trays move along the chains until they come into contact with dams D. At dams D, the trays cease their motion, sliding on the underlying chains 40 while being held by dams D. This will be set forth hereafter.

Conveyor, Dams and Bridge Lifts

The conveyors C at empty conveyor $C_E$ and loaded conveyor $C_L$ are conventional. Their detail will be abbreviated. Typically, chain conveyors C at endless chains 40 support the tray T as the trays T are conveyed along the frame F. These conveyors move at one foot to one foot and one half per second and are normally on.

At each of the stations S1–S5 on each of the conveyors $C_E$–$C_L$, there are a system of dams and bridge lifts. It is the function of the dams to stop and register the trays to each of the stations S. It is the function of the bridge lifts to enable the rolling transport to and from the conveyors.

Referring to FIG. 2, a typical dam M and bridge lifts L are illustrated. Conveyor $C_L$ is shown conveying in the direction indicated by arrow 45. This conveyor has permanently installed side guides 46 on either side, which guides 46 maintain the longitudinal alignment of the tray T. Endless chain 40 runs in conventional raceways which are not shown. The tray is being conveyed to the particular station S shown in FIG. 2.

Each station S includes two bridge lifts L and a dam M.

With respect to dam M, it includes a pneumatic actuating mechanism 48, which mechanism 48 moves the dam M between a lowered position where the tray T may freely pass over the dam and a raised position where the tray T abuts and stops against the dam M. When dam M, commonly constructed of metal, such as aluminum, is raised, tray T on the chain is conveyed along until collision occurs with the raised dam M. This causes the tray T to stop at the correct position with respect to station S. Moreover, the tray T is registered to the station S so that either removal or loading of the tray T can occur.

Bridge lifts L function to permit the tray T to be moved at right angles to the conveyor $C_L$. When the bridge lifts L are up as by the actuation of the pneumatic cylinders 53, rolling transport of the tray T on wheels 31–34 can occur. When the bridge lifts are lowered, the tray can pass over the bridge lift as well as be deposited on the endless conveyor chain 40 for transport. Pneumatics for the operation of the bridge lifts is schematically shown, it being realized that virtually any mechanical expedient will serve this purpose.

It will be understood that the view of FIG. 2 is illustrated for a station S on lower conveyor $C_L$ which conveys trays T packed with heads of lettuce. The structure at conveyor $C_E$ is analogous; it is therefore not shown. However, it will be understood that conveyance is in the opposite direction. Consequently, dams D are at the opposite end of the tray T.

Tray Handling Arms and Associated Cradles

Figure 5:
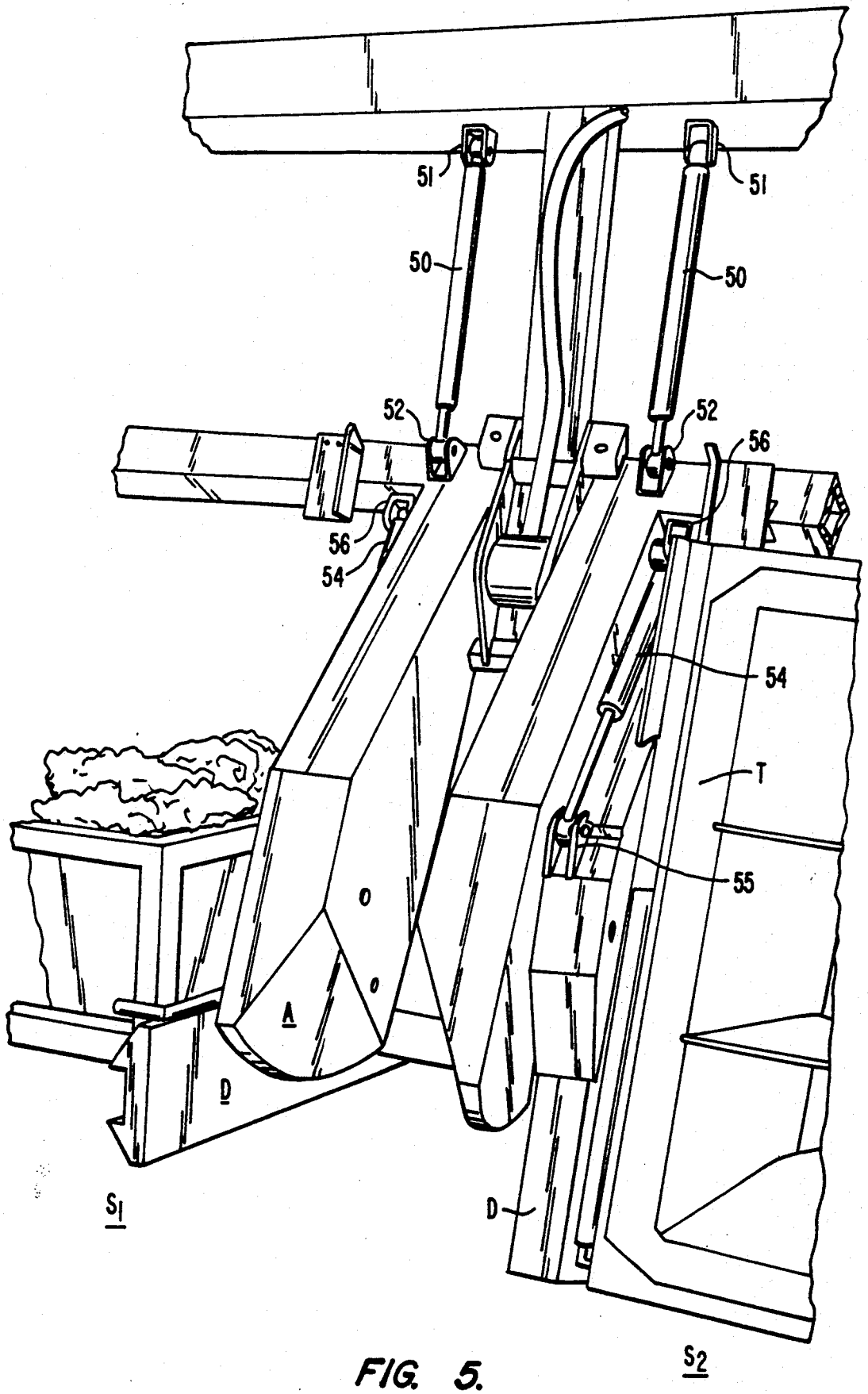
FIG. 5 is a detail of the counter balanced arms on the main machine frame illustrating the placement of the arm movement stops and over center arm pneumatic spring.

With respect to FIGS. 3A, 3B and 5, the tray handling arms A and cradles D utilized for handling of the trays T can be understood.

Referring to FIGS. 3A and 3B, arms A constitute counter-weighted members. These arms pivot about a pivot P1 on frame F of the harvester. These counter weighted arms A pivot against over center pneumatic cylinders 50, described in more detail hereafter.

Each pair of arms at each station S has fastened thereto a cradle D. Cradle D pivots about from the arms at a position P2. These cradles D pivot against over center pneumatic cylinders 54, described in more detail hereafter.

It can therefore be understood that arm A can move from a position registered to upper conveyor $C_E$ to a position registered to lower conveyor $C_L$. Referring to FIG. 3A, arm A is shown registered to conveyor $C_E$; arm A is shown in broken lines registered to lower conveyor $C_L$.

Referring to FIG. 3B, arm A is shown in a lowered position. It is in this position that the tray T is packed with freshly harvested lettuce from the lettuce crop.

Arms A include an over-center pneumatic spring 50. Spring 50 attaches to frame F at clevis 51 and to arm A at clevis 52. The over center pneumatic spring is given sufficient force to counter balance the arms A and cradle D to the upward position without the weight of a tray T. The over center pneumatic spring is given insufficient force to counter balance the arms A and cradle D to the upward position with the weight of a tray T. Consequently, when the arms A are in an upwardly biased disposition and the cradle D is loaded with a tray T, the arms A and cradle D move under the weight of the tray T to the lowered disposition.

It is to be understood that all movement of the arms A is damped by a hydraulic damper H (see FIGS. 3A, 3B, 6C, and 6E). This gives controlled, shock-free movement of arms A.

The action of over-center pneumatic spring 50 with respect to arm A can be understood. Referring to FIG. 3B, pneumatic spring 50 is shown in the over-center position. In this position, arm A will be held to the lowered position. This maintenance of arm A in the lowered disposition will occur due to the over center placement of pneumatic spring 50, even though spring 50 would otherwise exert sufficient force on arms A and cradle D to bias the arms A and cradle D to the upward position.

When arm A is partially moved toward the upwardly disposed position, pneumatic spring 50 passes over center. Pneumatic spring 50 then biases the counter-weighted arm A to an upward position.

As will hereinafter be made clear, the arm A in its pivot about pivot P1 is biased by the worker to iniate movement over center from the lower position where registration to conveyor $C_L$ occurs to the upper position where registration of the cradle D to conveyor $C_E$ occurs.

Having set forth the function of arm A and with its movement about pivot P1, the action of cradle D and its pivot about pivot P2 on arm A can now be discussed.

Cradle D gravitationally biases itself with respect to pivot P2 on arm A. Absent all other forces, cradle D would be horizontal with respect to pivot P2 on arm A in all positions.

Like arm A with respect to pivot Pl, cradle D with respect to pivot P2 includes an over-center spring 54. Over-center pneumatic spring 54 attaches to arm A at clevis 56 and to cradle D at clevis 55. The function of this spring can best be seen with respect to FIG. 3A and then FIG. 3B.

When arms A pivot to the upper position, over center pneumatic spring 54 locks to the over center position. In this over center position, the cradle to arm relationship is fixed. This much can be seen in FIG. 3A.

When arms A pivot to the downward position, the cradle to arm relationship remains fixed. The cradle is thus angularly disposed at an angle of approximately 15° from the vertical for the packing of the lettuce heads to the individual cells of the trays T.

Thereafter, and when a tray is full, cradle D is pivoted from the position shown in solid lines in FIG. 3B to a horizontal position shown in broken lines in FIG. 3A. When cradle D is in this position, the tray can be pushed from the cradle D in the direction of arrows 65. Rolling transport on its wheels 31–34 onto raised and awaiting bridge lifts can occur. The over-center movement will initially be resisted by the over-center pneumatic spring 54. However, once pivotal movement of the cradle D with respect to the arm A occurs, the tray will pivot from the angular position shown in FIG. 3B to the horizontal position shown in FIG. 3A.

Referring to FIG. 3A and 3B, tray T is received into raceways 57 on cradle D. The tray T enters these raceways 57 until it abutts an adjustable stop 58. Adjustable stop 58 limits the penetration of tray T in cradle D. Thus when tray T is in the position shown in FIG. 3B, the height of the tray T from the ground is adjustable.

Operation of Arms, Cradle and Tray

Having set forth the construction of the arms A, cradle D, and tray T, the overall operation of this apparatus during harvest can be understood with respect to FIG. 6A–6G. In referring to the cartoon series in FIGS. 6A–6G, reference will be made to the mechanical details illustrated in FIGS. 3A, 3B.

Figure 6A:
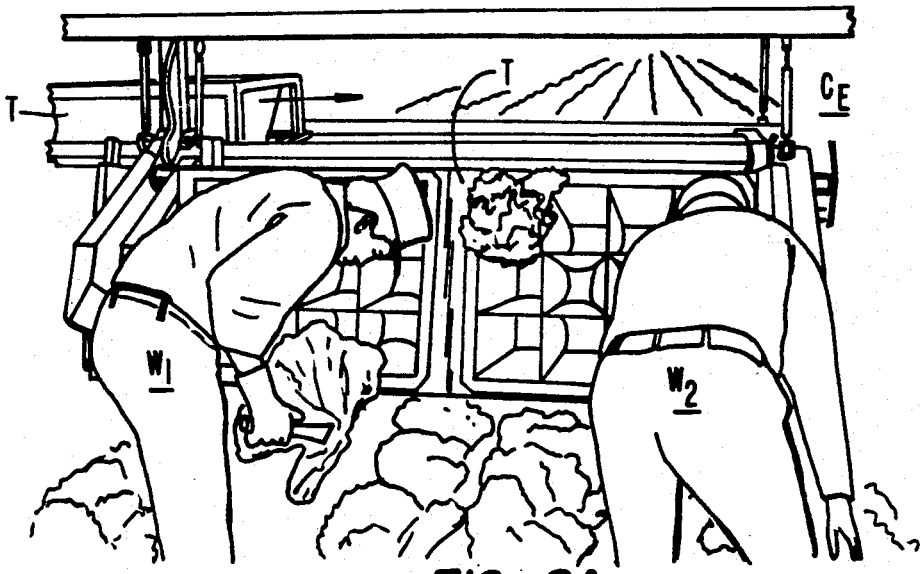
FIG. 6A–6G are a cartoon series of the packing station illustrating the movements of the trays from the upper empty tray conveyor to the lower full tray conveyor on the harvester; and, FIG. 7 is a logic diagram illustrating schematically sensor state and machine logic so that the automated sequencing of the conveyor in supplying empty trays to and receiving full trays from the packing stations can be fully understood.
Figure 6B:
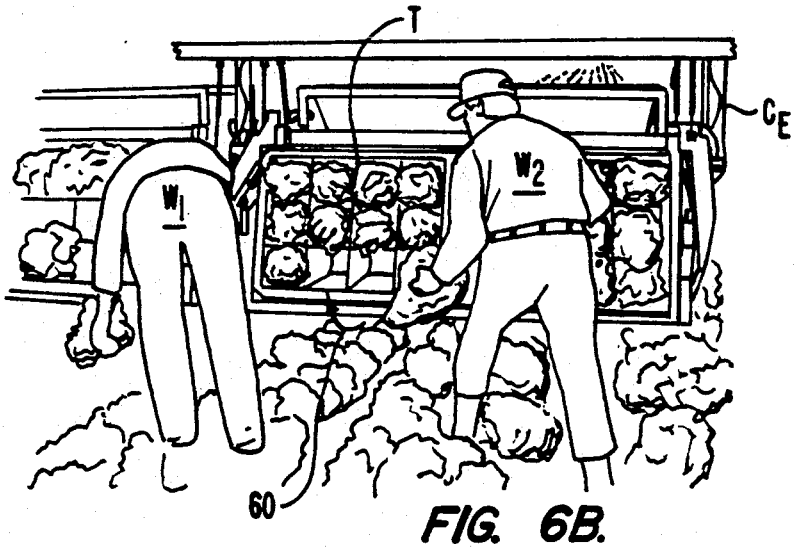
Figure 6C:
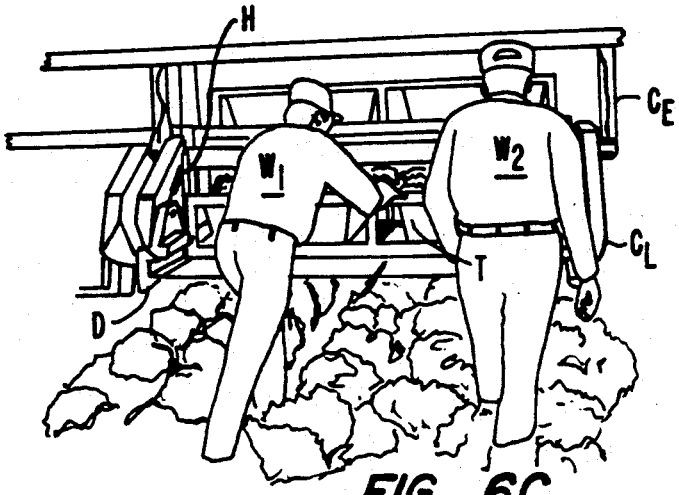

Referring to FIGS. 6A and 6B, the position of the tray T is that position shown in solid lines in FIG. 3B. It can be seen that the tray T is angularly disposed with respect to the crop at an approximate 15° angle with respect to the vertical. Workers W1, W2 are shown packing harvested lettuce to the discrete cells within tray T.

At FIG. 6B it can be seen that tray T is almost completely loaded. When such complete loading occurs, tipping of the tray T will occur in the direction of arrow 60 (see both FIG. 6B and FIG. 3A). This will bias over-center spring 54 and cause the tray to move the cradle D to the horizontal position shown in broken lines in FIG. 3A. In this position, wheels 31–34 at bottom of the tray T will roll along the cradle D and onto bridge lifts L overlying conveyor $C_L$. A loaded tray of lettuce will thus pass from the cradle D to the loaded conveyor $C_L$. This is done by the workers W1 or W2 pushing the rolling tray against rolling resistance only onto the conveyor (see FIG. 6C).

Figure 6D:
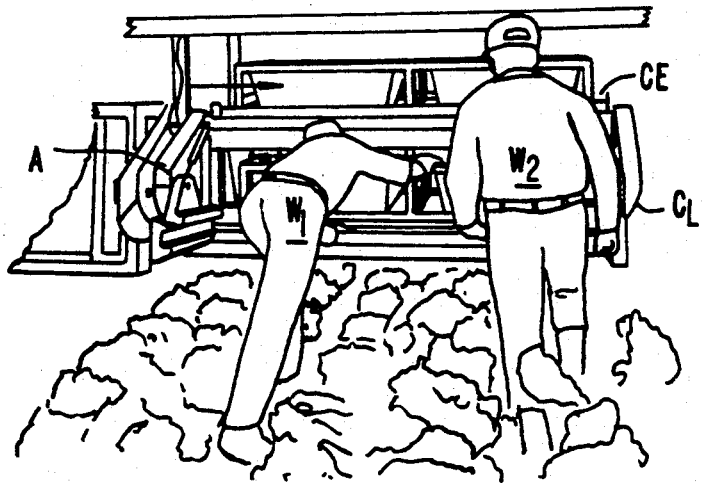
Figure 6E:
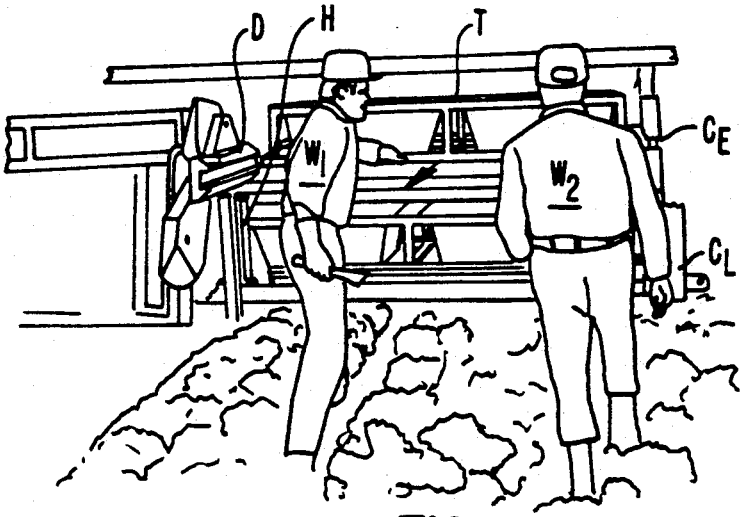
Figure 6F:
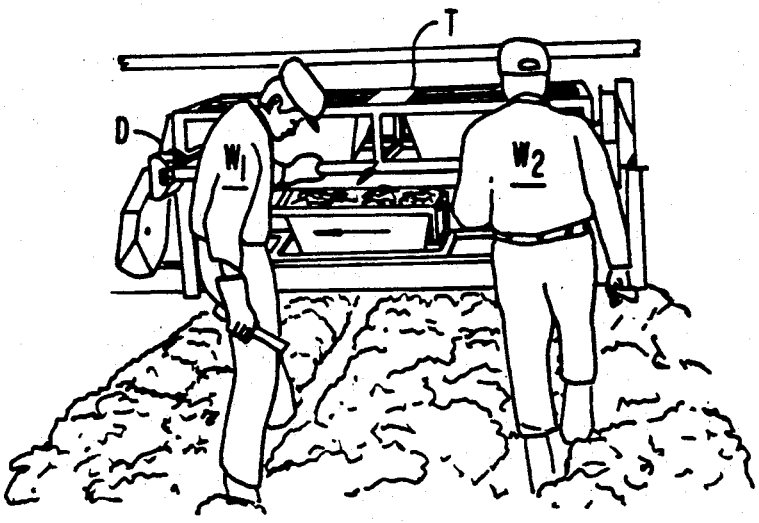

Once this movement occurs, the worker such as worker W2 will typically bias arm A upwardly (see FIG. 6D). In such bias, over-center spring 50 will urge the counter-weighted arm A to the arm position shown in solid lines in FIG. 3A. Controlled upward movement of arms A and cradle D will occur against damping cylinder H.

During this motion, movement of the cradle D about pivot P2 on arm A will occur. Specifically, cradle B is gravitationally biased with respect to pivot P2. As are A raises, it will overcome the force of over-center spring 54. The cradle D will pivot with respect to arm A. It will pivot and lock in the spring over-center position in FIG. 3A of the top portion thereof. In this position, a worker such as worker W1 in FIG. 6E can pull an empty tray into the awaiting cradle D. Such pulling will occur until the tray T has fully penetrated the cradle D.

Referring to FIG. 3A and once full penetration of the cradle D by a tray T has occurred, the weight of the tray T in the cradle D as shown in FIG. 3A will overcome the force on over-center pneumatic spring 50.

Figure 6G:
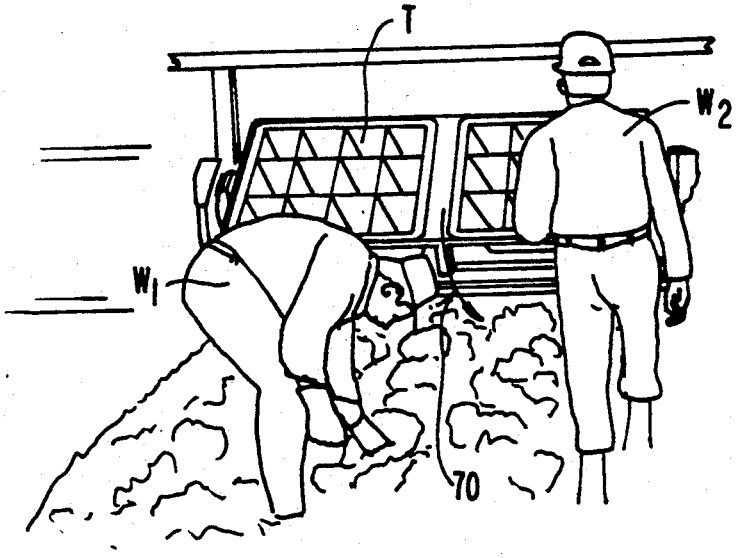

The arm A will pivot downward to the position shown in FIG. 3B. In the position shown in FIG. 3B, the tray will be disposed for convenient loading of produce as is shown in FIG. 6G. Rotation occurs in the direction of arrows 70 (see FIGS. 6G and 3B). In this rotation, over-center pneumatic spring 54 will maintain the tray T in the same angularity with respect to arms A as when the tray T was received within the cradle D. This angularity in the lowered position is the loading position of the tray T for the workers W in the field.

It will be understood that cradle and arm movement occurs against conventional stops that limit movement. Arm stops limit the upper and lower movement of arms A; cradle stops limit the pivotal movement of the cradle D with respect to arms A. As such stops are conventional, they will not be shown or illustrated.

It will be understood that all action and movement of the tray T here illustrated is either worker-assisted or gravity biased. Automated and forcible movement with hydraulics is avoided. The system is completely passive and simply operated by the workers.

Automated Operation

Having set forth the overall construction of the apparatus of this invention, attention can now be devoted to the automated routing of the trays to and from the cradle D supported on the arms A. In the following discussion sensor location will first be set forth. Thereafter, the logic in the routing of the trays will be discussed so that the operation utilized can be understood by those having skill in the computer arts.

Sensor Location

Sensor Al is the arm position sensor. It emits a signal when the arm A is in the up position. This sensor may be placed in any position with respect to arm A where it senses the arm A in the full up position (see FIG. 3A). It will be remembered that movement to this position occurs when the worker W1 or W2 initiates the bias of the arms A against the over center gas spring.

Sensor D1 is the proximity sensor which senses the cradle D. (See FIG. 3A where tray T is illustrated in broken lines.) Biasing of the cradle D to the receive position at the lower conveyor $C_L$ causes this sensor to emit a signal. This sensor may be placed in any position with respect to cradle D where it senses the movement of cradle D to the horizontal position relative to arms A.

Observing the connection of these two sensors, two observations can be made.

First, and when the tray T is in the 15° inclined position for the receipt and packing of harvested heads of lettuce, no signal is emitted from either of the two sensors $A_1$ or $D_1$. Secondly, when the signals are emitted, they track the progress of the workers W1 and W2. No special switches or other signals are used.

It will be understood that the particular location of these sensors is not critical; they may be located anywhere on the arms A or cradle D so long as the proper movement of the respective arms A and cradle D is indicated.

It is necessary to know the location of the trays T as they progress along the conveyor. This being the case, photo sensors are utilized. Each of these photo sensors is located ⅓ the length from the beginning of a particular station S in the direction of the movement of the trays T. Further, it is also necessary to know the status of the upstream station on each conveyor. This being the case, the status of the same sensor in the upstream direction is indicated.

Because only one sensor is utilized in each case, and because each sensor is only partially into the particular station, clocks allowing for the remainder of the traverse of the tray T into any station must be utilized with the software. Since the programming of such clocks into software is well understood in the art and is only a function of the particular velocity of the conveyors utilized - it will not be further discussed herein.

Figure 4A:
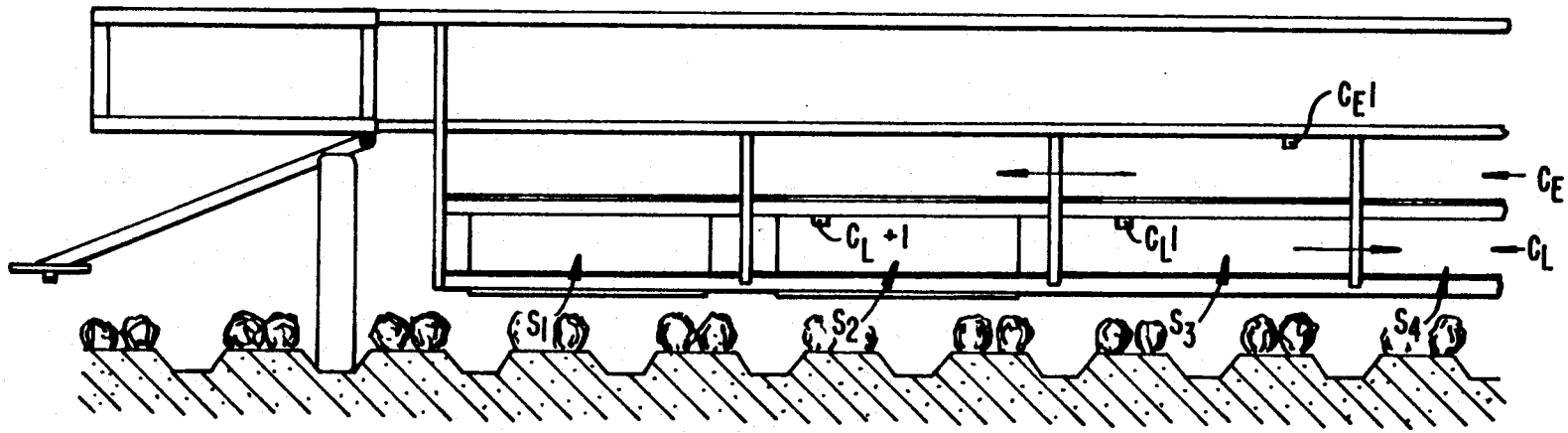
FIG. 4A and 4B are a side elevation of the harvester at the frame for illustrating the respective conveyors and sensors associated with the conveyors so that the sequence of supplying empty trays and removing full trays from any particular station can be understood.
Figure 4B:
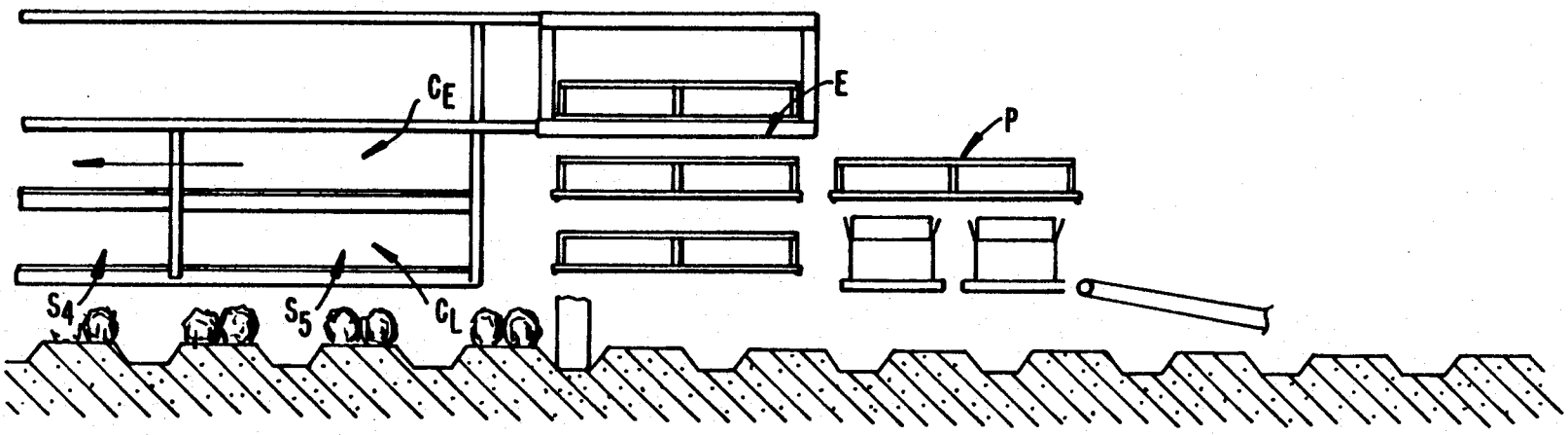

Reference will now be made to FIG. 4A and 4B. Station $S_3$ will be used for the logic illustration. Conveyor $C_E$ conveys away from elevator E and plunge station P. Conveyor $C_L$ conveys towards elevator E and plung station P.

$C_L$1 is the photo sensor located on the loaded conveyor $C_L$ at the station $S_3$. $C_L+$1 is the photo sensor on the station S upstream from the station chosen.

$C_E$1 is the photo sensor at the station S on the empty tray conveyor and $C_E$-1 is the photo sensor located on the station S which is immediately in the downstream direction of flow from the conveyor $C_E$.

The reader will understand logic and sensors are only illustrated for one station, station $S_3$. Since operation of the remaining stations is analogous, further detail will not be provided.

Symbols are utilized to indicate the sensor states. An open circle indicates the sensor being in the on state—that is the detection of the position of the arm A or cradle D or the presence of a tray T at the particular sensor in the particular station. Where the open circle has a line drawn through it, this position is no longer indicated. These symbols may be seen on FIG. 7.

Operational Logic

Figure 7:
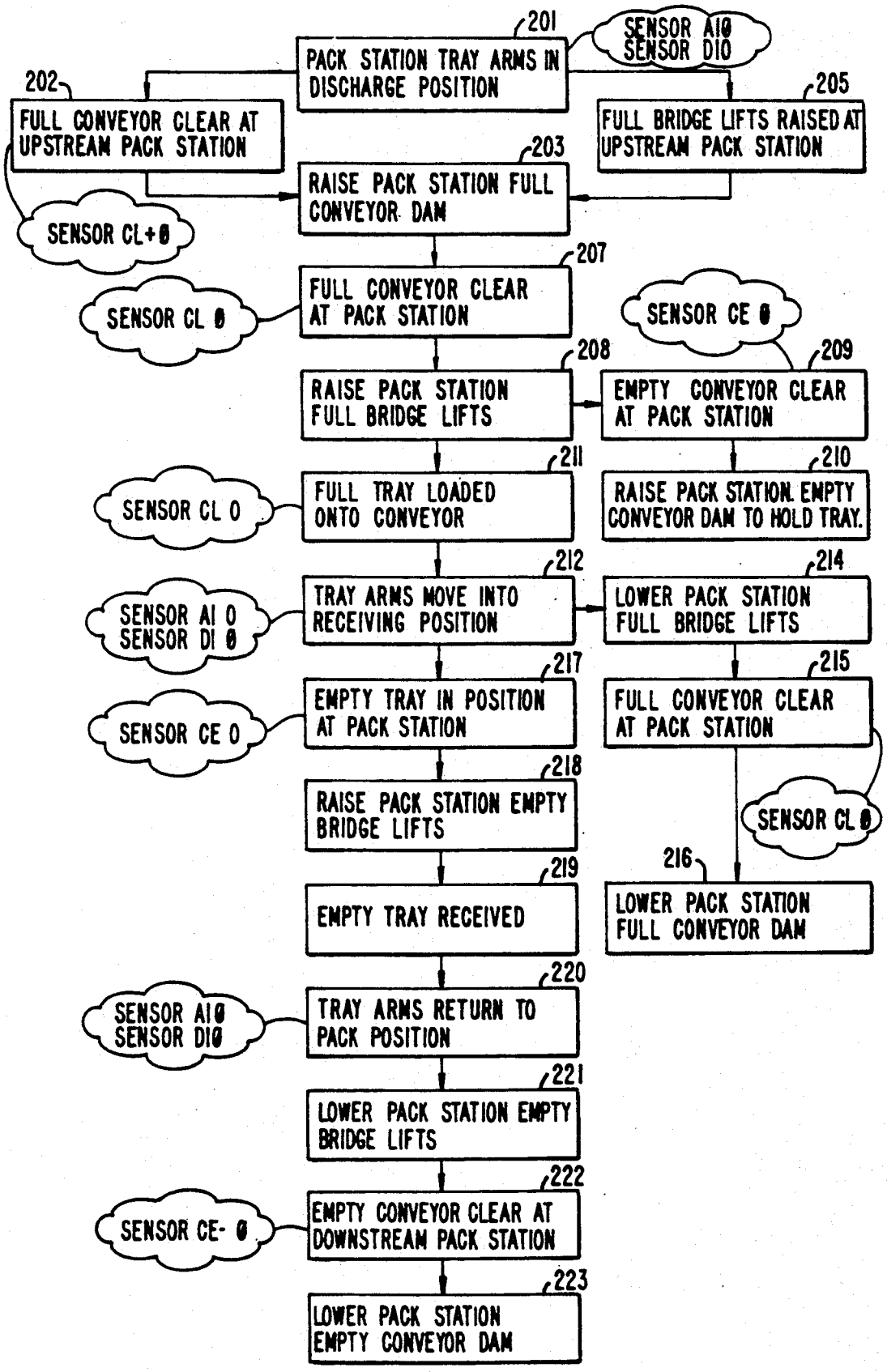

We now go to the top of the logic diagram of FIG. 7. It is assumed that we have at a pack station $S_3$, tray arms A in the discharge position (see 201). The tray having been fully packed with lettuce is being tilted from an approximate 15° angle with respect to the vertical so that its is horizontal for the rolling discharge of a full tray T. It will be understood that sensor D1 at the cradle D emanates a signal.

In this condition it is required that there be a vacancy in conveyor $C_L$ at the particular station $S_3$ so that off loading of the packed tray T can occur (see 207).

It is also necessary to know the status of the upstream station S to determine if that station is occupied by a tray T. That sensor $C_L$1+ needs to be clear or off (see 202).

When these two conditions are met, the computer logic will raise the dam to stop any oncoming trays so that the worker can load his tray onto the conveyor (see 203).

Consider the case if a tray T occupies the station $S_3$ on conveyor $C_L$ where the off loading is about the occur. If the station S is full at conveyor $C_L$, then the logic waits until station $S_3$ clears before it raises the dam immediately up stream from the station (see 202).

The case must be considered with the upstream station S is cleared—but the workers in that station are themselves discharging a loaded tray.

It will be remembered that the computer logic will have caused the bridge lifts at the upstream station to raise. Thus, it will be known in the computer logic that the upstream bridge lifts are in the raised position—even though the that upstream station S is otherwise empty (see 205).

In either case, we know it is alright to bring up the dam (see 203). Thus it can be seen that either the up stream station has to be clear, or in the process of loading a tray onto the conveyor for logic 203 to be actuated.

Then we raise the pack station bridge lifts (see 208). This enables the full tray in the cradle D to be pushed onto the convey or $C_L$ (see 211).

With sensor D1 seeing cradle D move to the discharge position, one other phenomena occurs. The pack station empty conveyor $C_E$ dam will raise to hold an empty tray T at the station in readiness for the raising of arms D and the registration of cradle D to conveyor $C_E$ (see 209, 210).

At this point, workers W1 or W2 bias arms A into the upward or tray receive position (see 212). When this occurs, lower pack station bridge lifts are lowered (see 214), the full conveyor $C_L$ is cleared at the pack station S3 (see 215), and the dam at the pack station on the full conveyor $C_L$ is lowered (see 216).

It will be remembered that a dam M has been raised at conveyor $C_E$. An empty tray T will be sensed upon arrival at this station S3 (see 217). This will raise the pack station empty bridge lifts (see 218) followed by the receipt of the empty tray T in the cradle D (see 219).

At this point, the reader will remember that when an empty tray T is pulled into the cradle D, the arms A then fall downward (see 220). At the same time, and due to the action of the over center pneumatic spring on the cradle, tray T remains in the pack position. No signal is emitted from the particular station S.

Thereafter the pack station full bridge lifts lower below the conveyor $C_E$ (see 221). If the empty conveyor $C_E$ downstream pack station is clear, the pack station dam M is lowered (See 222,223).

We have not included the programming logic. Those having skill in the art can readily program utilizing the logic of FIG. 7.

What is claimed is:

1. In a harvester having a transportable frame moveable over a field of planted crop to be harvested, said frame mounting a first conveyor for supplying empty produce receiving trays, a second conveyor for conveying full packed produce receiving trays, and a loading station for receiving loaded trays from said second conveyor, loading produce in said trays into cartons, and discharging empty trays to said first conveyor, a station for moving said produce receiving trays from said first conveyor supplying empty trays to a packing disposition with respect to a crop to be harvested and for conveying said packed trays to said second conveyor for transport to said loading station comprising:

arms having a first pivot mounted to said frame for permitting said arms at outer ends opposite from said pivot to move at the end remote from said pivot between a first position adjacent to said first conveyor to a second position adjacent said second conveyor;

a tray receiving cradle pivoted to said arms, means for mounting said cradle at the outer end of said arms for pivotal movement relative to said arms while said arms are adjacent said second conveyor for receiving and discharging a produce receiving tray, said cradle in registration with said first conveyor when said arms are in said first pivoted position and in registration with said second conveyor when said cradle is pivoted relative to said arms when said arms are in said second pivoted position;

means for moving attached to said first conveyor for moving an empty tray from said first conveyor for transport to said registered cradle for loading said cradle with said empty produce receiving tray;

means for moving attached to said second conveyor for moving a full produce receiving tray relative to said second conveyor for transport of said tray from said cradle to said second conveyor; and, cradle pivot restraint means acting between said pivoting arms and said cradle for maintaining said tray receiving cradle and contained tray at an angle with respect to the field of said crop.

2. The harvester of claim 1 wherein said arms are counter balanced in said pivotal movement for moving adjacent said first conveyor when said cradle is empty and moving adjacent said second conveyor when said cradle is full with a produce receiving tray.

3. The harvester of claim 1 wherein said cradle pivot restraint means includes an over center spring.

4. The harvester of claim 1 and including:

second arms having a first pivot mounted to said frame on a side opposite from said first arms for permitting said second arms at ends opposite from said pivot to move at the end remote from said pivot between a first position adjacent to said first conveyor to a second position adjacent said second conveyor;

a second tray receiving cradle pivoted to said second arms at the outer end thereof for receiving and discharging a produce receiving tray, said cradle in registration with said first conveyor when said arms are in said first pivoted position and in registration with said second conveyor when said arms are in said second pivoted position.

5. A harvester comprising in combination, a transportable frame moveable over a field of planted crop to be harvested;

a plurality of produce receiving trays for receiving lettuce at a first location and transporting lettuce for packing into cartons at a second location;

a first conveyor mounted on said frame transversely across the direction of movement of said frame with respect to said crop for supplying empty produce receiving trays;

a second conveyor mounted on said frame transversely across the direction of movement of said frame with respect to said crop for conveying fully packed produce receiving trays;

a loading station for receiving loaded trays from said second conveyor, loading produce in said trays into cartons, and discharging empty trays to said first conveyor;

a plurality of stations for moving said produce receiving trays from said first conveyor supplying empty trays to a packing disposition with respect to a crop to be harvested and for conveying said packed trays to said second conveyor for transport to said loading station; each said station including:

arms having a first pivot mounted to said frame for permitting said arms at outer ends opposite from said pivot to move at the end remote from said pivot between a first position adjacent to said first conveyor to a second position adjacent said second conveyor;

a tray receiving cradle pivoted to said arms, means for mounting said cradle at the outer end of said arms for pivoted movement relative to said arms while said arms are adjacent said second conveyor for receiving and discharging a produce receiving tray, said cradle in registration with said first conveyor when said arms are in said first pivoted position and in registration with said second conveyor when said cradle is pivoted relative to said arms when said arms are in said second pivoted position;

first transfer means attached to said first conveyor for transporting an empty tray from said first conveyor for transport to said registered cradle for loading said cradle with said empty produce receiving tray;

second transfer means attached to said second conveyor for transporting a full produce receiving tray relative to said second conveyor for transport of said tray from said cradle to said second conveyor; and, cradle pivot restraint means acting between said pivoting arms and said cradle for maintaining said tray receiving cradle and contained trays at an angle with respect to the field of said crop.

6. The harvester of claim 5 wherein said arms are counter balanced in said pivotal movement for moving adjacent said first conveyor when said cradle is empty and moving adjacent said second conveyor when said cradle is full with a produce receiving tray.

7. The harvester of claim 5 wherein said cradle pivot restraint means includes an over center spring.

8. The harvester of claim 5, including:

second arms having a first pivot mounted to said frame on a side opposite from said first arms for permitting said second arms at ends opposite from said pivot to move at the end remote from said pivot between a first position adjacent to said first conveyor to a second position adjacent said second conveyor;

a second tray receiving cradle pivoted to said second arms at the outer end thereof for receiving and discharging a produce receiving tray, said cradle in registration with said first conveyor when said arms are in said first pivoted position and in registration with said second conveyor when said arms are in said second pivoted position.

9. A harvester comprising in combination, a transportable frame moveable over a field of planted crop to be harvested;

a plurality of produce receiving trays for receiving lettuce at a first location and transporting lettuce for packing into cartons at a second location;

a first conveyor mounted on said frame transversely across the direction of movement of said frame with respect to said crop for supplying empty produce receiving trays;

a second conveyor mounted on said frame transversely across the direction of movement of said frame with respect to said crop for conveying full packed produce receiving trays;

a loading station for receiving loaded trays from said second conveyor, loading produce in said trays into cartons, and discharging empty trays to said first conveyor;

a plurality of stations for moving said produce receiving trays from said first conveyor supplying empty trays to a packing disposition with respect to a crop to be harvested and for conveying said packed trays to said second conveyor for transport to said loading station; each said station including:

arms having a first pivot mounted to said frame for permitting said arms at outer ends opposite from said pivot to move at the end remote from said pivot between a first position adjacent to said first conveyor to a second position adjacent said second conveyor;

a tray receiving cradle pivoted to said arms, means for mounting said cradle at the outer end of said arms for pivoted movement relative to said arms while said arms are adjacent said second conveyor for receiving and discharging a produce receiving tray, said cradle in registration with said first conveyor when said arms are in said first pivoted position and in registration with said second conveyor when said cradle is pivoted relative to said arms when said arms are in said second pivoted position;

first transfer means attached to said first conveyor for transporting an empty tray from said first conveyor for transport to said registered cradle for loading said cradle with said empty produce receiving tray;

second transfer means attached to said second conveyor for transporting a full produce receiving tray relative to said second conveyor for transport of said tray from said cradle to said second conveyor;

cradle pivot restraint means acting between said pivoting arms and said cradle for maintaining said tray at an angle with respect to the field of said crop;

first stops on said first conveyor for stopping empty trays for receipt to said cradle of said station;

second stops on said second conveyor for stopping full trays to enable said second conveyor to cause said conveyed full trays to define an interval for the receipt of full trays at said station;

first sensor means connected to said cradle for actuating said first and second stops and said second transfer means upon movement of said cradle to a position for discharging full lettuce receiving trays from said cradle to said second conveyor; and, second sensor means connected to said arms for actuating said first transfer means for permitting an empty lettuce receiving tray from said first conveyor to move to said cradle.

10. The harvester of claim 9 wherein said arms are counter balanced in said pivotal movement for moving adjacent said first conveyor when said cradle is empty and moving adjacent said second conveyor when said cradle is full with a produce receiving tray.

11. The harvester of claim 9 wherein said cradle pivot restraint means includes an over center spring.

12. The harvester of claim 9, including:

second arms having a first pivot mounted to said frame on a side opposite from said first arms for permitting said second arms at ends opposite from said pivot to move at the end remote from said pivot between a first position adjacent to said first conveyor to a second position adjacent said second conveyor;

a second tray receiving cradle pivoted to said second arms at the outer end thereof for receiving and discharging a produce receiving tray, said cradle in registration with said first conveyor when said arms are in said first pivoted position and in registration with said second conveyor when said arms are in said second pivoted position;

third sensor means connected to said second tray receiving cradle for actuating said first and second stops and said second transfer means upon movement of said cradle to a position for discharging full lettuce receiving trays from said cradle to said second conveyor; and, fourth sensor means connected to said second arms for actuating said first transfer means for permitting an empty lettuce receiving tray from said first conveyor to move to said cradle.

13. A harvester comprising in combination:

a transportable frame moveable over a field of planted crop to be harvested;

a plurality of produce receiving trays for receiving lettuce at a first location and transporting lettuce for packing into cartons at a second location;

a first upper conveyor mounted on said frame transversely across the direction of movement of said frame with respect to said crop for supplying empty produce receiving trays;

a second lower conveyor mounted on said frame transversely across the direction of movement of said frame with respect to said crop for conveying full packed produce receiving trays;

a loading station for receiving loaded trays from said second conveyor, loading produce in said trays into cartons, and discharging empty trays to said first conveyor;

a plurality of stations for moving said produce receiving trays from said first conveyor supplying empty trays to a packing disposition with respect to a crop to be harvested and for conveying said packed trays to said second conveyor for transport to said loading station; each said station including:

arms having a first pivot mounted to said frame for permitting said arms at outer ends opposite from said pivot to move at the end remote from said pivot between a first position adjacent to said first conveyor to a second position adjacent said second conveyor;

a tray receiving cradle pivoted to said arms, means for mounting said cradle at the outer end of said arms for pivoted movement relative to said arms while said arms are adjacent said second conveyor for receiving and discharging a produce receiving tray, said cradle in registration with said first conveyor when said arms are in said first pivoted position and in registration with said second conveyor when said cradle is pivoted relative to said arms when said arms are in said second pivoted position;

means for biasing said arms and cradle to a position of juxtaposition to said first upper conveyor with a force sufficient to bias said arms to said upper position when said cradle is empty of a lettuce receiving tray and a force insufficient to bias said arms to said upper position when said cradle is full with said lettuce receiving tray whereby said arm pivots downward when a lettuce receiving tray is received in said cradle.

14. The invention of claim 13, including:

cradle pivot restraint means acting between said pivoting arms and said cradle for maintaining said tray at an angle with respect to the field of said crop;

said cradle pivot restraint means locking said cradle with respect to said arms when said arms are adjacent said upper first conveyor and maintaining said cradle stationary with respect to said arms when said arms move to said lower position.

15. The invention of claim 13, including:

arm pivot restraint means acting between said frame and said pivoting arms for maintaining said arms and cradle at a lower elevation with respect to said frame, said arm pivot restraint means being capable of being overcome by manual movement of said arms.

16. The invention of claim 15 wherein said arms includes means for restraining said empty trays to said upper conveyor when said arms and cradle are pivot to positions adjacent said lower conveyor.

17. A harvester comprising in combination:

a transportable frame moveable over a field of planted crop to be harvested;

a plurality of produce receiving trays for receiving lettuce at a first location and transporting lettuce for packing into cartons at a second location;

a first upper conveyor mounted on said frame transversely across the direction of movement of said frame with respect to said crop for supplying empty produce receiving trays;

a second lower conveyor mounted on said frame transversely across the direction of movement of said frame with respect to said crop for conveying full packed produce receiving trays;

a loading station for receiving loaded trays from said second conveyor, loading produce in said trays into cartons, and discharging empty trays to said first conveyor;

a plurality of stations for moving said produce receiving trays from said first conveyor supplying empty trays to a packing disposition with respect to a crop to be harvested and for conveying said packed trays to said second conveyor for transport to said loading station; each said station including:

arms having a first pivot mounted to said frame for permitting said arms at outer ends opposite from said pivot to move at the end remote from said pivot between a first position adjacent to said first conveyor to a second position adjacent said second conveyor;

a tray receiving cradle pivoted to said arms, means for mounting said cradle at the outer end of said arms for pivoted movement relative to said arms while said arms are adjacent said second conveyor for receiving and discharging a produce receiving tray, said cradle in registration with said first conveyor when said arms are in said first pivoted position and in registration with said second conveyor when said cradle is pivoted relative to said arms when said arms are in said second pivoted position;

said tray receiving cradle comprising a U-shaped frame disposed to said conveyor defining tracks for receiving said tray on opposed sides of said U-shaped frame; and, means on said trays for rolling transport of said trays in said tracks whereby said trays can be received from said conveyors into said tracks.

18. The invention of claim 17, further including means for biasing said arms and cradle to a position of juxtaposition to said first upper conveyor with a force sufficient to bias said arms to said upper position when said cradle is empty of a lettuce receiving tray and a force insufficient to biase said arms to said upper position when said cradle is full with said lettuce receiving tray whereby said arm pivots downward when a lettuce receiving tray is received in said cradle.

19. The invention of claim 17, further including:

means attached to said tracks on said cradles for permitting controllable penetration of said tray into said cradle; and cradle pivot restraint means acting between said pivoting arms and said cradle for maintaining said tray at an angle with respect to the field of said crop;

said cradle pivot restraint means locking said cradle with respect to said arms when said arms are adjacent said upper first conveyor and maintaining said cradle stationary with respect to said arms when said arms move to said lower position.

20. A process of harvesting comprising the steps of:

providing a frame moveable over a field of planted crop to be harvested;

providing a plurality of produce receiving trays for receiving lettuce at a first location on said frame and transporting lettuce for packing into cartons at a second location on said frame;

providing a first conveyor mounted on said frame transversely across the direction of movement of said frame with respect to said crop for conveying empty produce receiving trays;

providing a second conveyor mounted on said frame transversely across the direction of movement of said frame with respect to said crop for conveying full packed produce receiving trays;

providing a loading station for receiving loaded trays from said second conveyor, loading produce in said trays into cartons, and discharging empty trays to said first conveyor;

providing a plurality of stations for moving said produce receiving trays from said first conveyor supplying empty trays to a packing disposition with respect to a crop to be harvested and for conveying said packed trays to said second conveyor for transport to said loading station;

providing arms at each station having a first pivot mounted to said frame for permitting said arms at outer ends opposite from said pivot to move at the end remote from said pivot between a first position adjacent to said first conveyor to a second position adjacent said second conveyor;

providing a tray receiving cradle at each station pivoted to said arms, means for mounting said cradle at the outer end of said arms for pivoted movement relative to said arms while said arms are adjacent said second conveyor for receiving and discharging a produce receiving tray, said cradle in registration with said first conveyor when said arms are in said first pivoted position and in registration with said second conveyor when said cradle is pivoted relative to said arms when said arms are in said second pivoted position;

providing first transfer means attached to said first conveyor at each station for transporting an empty tray from said first conveyor for transport to said registered cradle for loading said cradle with said empty produce receiving tray;

providing second transfer means attached to said second conveyor at each station for transporting a full produce receiving tray relative to said second conveyor for transport of said tray from said cradle to said second conveyor; and, providing cradle pivot restraint means at each station acting between said pivoting arms and said cradle for maintaining said tray at an angle with respect to the field of said crop;

providing first stops on said first conveyor at each station for stopping empty trays for receipt to said cradle of said station;

providing second steps on said second conveyor at each station for stopping full trays to enable said second conveyor to cause said conveyed full trays to define an interval for the receipt of full trays at said station;

providing first sensor means connected to said cradle at each station;

actuating said first and second stops and said second transfer means responsive to said first sensor means upon movement of said cradle to a position for discharging full lettuce receiving trays from said cradle to said second conveyor at least one station;

providing second sensor means connected to said arms for emitting a signal when said arms are in the upward pivoted position at said at least one station; and, actuating said second transfer means responsive to said second sensor means for permitting an empty lettuce receiving tray from said first conveyor to move to said cradle at said at least one station.

* * * * *